US008133161B2

(12) United States Patent
Oshima et al.

(10) Patent No.: US 8,133,161 B2
(45) Date of Patent: Mar. 13, 2012

(54) CONDUCTIVE MEMBER, PROCESS CARTRIDGE, AND IMAGE FORMING APPARATUS

(75) Inventors: Tadayuki Oshima, Atsugi (JP); Hiroki Furubayashi, Atsugi (JP); Taisuke Tokuwaki, Sagamihara (JP); Toshio Kojima, Isehara (JP); Tadaaki Hattori, Hadano (JP); Yutaka Narita, Sagamihara (JP); Makoto Nakamura, Ebina (JP)

(73) Assignee: Ricoh Company, Ltd., Tokyo (JP)

( * ) Notice: Subject to any disclaimer, the term of this patent is extended or adjusted under 35 U.S.C. 154(b) by 1214 days.

(21) Appl. No.: 11/854,947

(22) Filed: Sep. 13, 2007

(65) Prior Publication Data

US 2009/0180806 A1 Jul. 16, 2009

(30) Foreign Application Priority Data

Sep. 13, 2006 (JP) ..... 2006-248167

(51) Int. Cl.
*G03G 15/20* (2006.01)

(52) U.S. Cl. ..... 492/18; 492/52; 492/56; 399/176; 428/383

(58) Field of Classification Search ..... 399/100, 399/357, 176, 168, 170, 388; 492/48, 59, 492/57, 56, 18, 53; 428/375, 383, 1, 32
See application file for complete search history.

(56) References Cited

U.S. PATENT DOCUMENTS

H916 H * 5/1991 Nishida ..... 525/66
5,804,309 A * 9/1998 Itoh et al. ..... 428/375
5,807,004 A * 9/1998 Takei et al. ..... 400/661.1
6,004,669 A * 12/1999 Rokutan et al. ..... 428/335
6,283,904 B1 * 9/2001 Itoh et al. ..... 492/56
6,321,062 B1 * 11/2001 Kitano et al. ..... 399/333
6,428,455 B1 * 8/2002 Sohl ..... 492/50
6,918,866 B2 * 7/2005 Miyamori et al. ..... 492/56
7,144,525 B2 * 12/2006 Yoshikawa et al. ..... 252/500
7,452,594 B2 * 11/2008 Pickering ..... 428/323
7,459,203 B2 * 12/2008 Pickering ..... 428/212
7,477,862 B2 * 1/2009 Takaya et al. ..... 399/100
2006/0188293 A1 8/2006 Narita et al.

(Continued)

FOREIGN PATENT DOCUMENTS

JP 3-240076 10/1991

(Continued)

OTHER PUBLICATIONS

U.S. Appl. No. 11/836,950, filed Aug. 10, 2007, Tokuwaki, et al.

(Continued)

*Primary Examiner* — David Bryant
*Assistant Examiner* — Jason L Vaughan
(74) *Attorney, Agent, or Firm* — Oblon, Spivak, McClelland, Maier & Neustadt, L.L.P.

(57) ABSTRACT

A conductive member includes a conductive support and an electrical resistance adjusting layer formed on the conductive support. The electrical resistance adjusting layer includes a thermoplastic resin, a polymeric ion conductive material, and a graft copolymer which is compatible with both of the thermoplastic resin and the polymeric ion conductive material. The electrical resistance adjusting layer is formed in a sea-island structure formed from a sea portion made of the polymeric ion conductive material and island portions made of the thermoplastic resin, the island portions being dispersed in the sea portion and each of the island portions is formed in an elongate shape. A layer made of the graft copolymer is formed at boundaries between the thermoplastic resin and the polymeric ion conductive material.

12 Claims, 9 Drawing Sheets

U.S. PATENT DOCUMENTS

| | | | | |
|---|---|---|---|---|
| 2006/0270541 | A1 | 11/2006 | Narita et al. | |
| 2007/0166076 | A1 | 7/2007 | Oshima et al. | |
| 2007/0196123 | A1* | 8/2007 | Mizuishi et al. | 399/100 |
| 2009/0030122 | A1* | 1/2009 | Matsuda et al. | 524/99 |

FOREIGN PATENT DOCUMENTS

| | | |
|---|---|---|
| JP | 2000-336212 | 12/2000 |
| JP | 3180861 | 4/2001 |
| JP | 2001-312121 | 11/2001 |
| JP | 2005-84626 | 3/2005 |
| JP | 2005-91818 | 4/2005 |
| JP | 2005-92134 | 4/2005 |
| JP | 2005-114950 | 4/2005 |
| JP | 2005-115204 | 4/2005 |

OTHER PUBLICATIONS

U.S. Appl. No. 11/837,751, filed Aug. 13, 2007, Nakamura, et al.
U.S. Appl. No. 12/044,521, filed Mar. 7, 2008, Oshima, et al.

* cited by examiner

CONDUCTIVE MEMBER, PROCESS CARTRIDGE, AND IMAGE FORMING APPARATUS

This application is based on and claims priority from Japanese Patent Application No. 2006-248167, filed on Sep. 13, 2006, the disclosure of which is incorporated herein by reference in its entirety.

BACKGROUND OF THE INVENTION

1. Field of the Invention

The present invention relates to a conductive member which is used in, for example, a copying machine, a laser-beam printer and a facsimile machine in an electrophotographic system, and disposed adjacent to a subject to be charged such as an image carrier. The present invention also relates to a process cartridge having the conductive member, and an image forming apparatus having the process cartridge.

2. Description of the Related Art

A conductive member is used as a charging member for performing a charging process to an image carrier such as a photoconductor and a transferring member for performing a transferring process to toner on the image carrier in an image forming apparatus of a conventional type in an electrophotographic system, including electrophotographic copying machines, laser beam printers and facsimile machines or the like. The conductive member which is used as a charging member will be explained below.

FIG. 1 is an explanatory diagram of a conventional image forming apparatus in an electrophotographic system.

In FIG. 1, reference number 11 indicates an electrostatic latent image carrier (photoconductor) on which an electrostatic latent image is formed, 12 a charging member (charging roller) which is disposed to contact with or disposed adjacent to the image carrier 11 and performs a charging process, 13 exposure light such as laser light or light reflected from an original, 14 a toner carrier (development roller) which transfers toner 15 onto the electrostatic latent image on an image carrier, 16 a transfer member (transfer roller) which transfers a toner image on the photoconductor onto a recording medium 17, and 18 a cleaning member (blade) which cleans the photoconductor after the transfer process. Moreover, reference number 19 indicates waste toner, which had remained on the photoconductor and then is removed by the cleaning member 18, 210 a development device, and 211 a cleaning device.

The other functional units generally required in the electrophotographic system are omitted in FIG. 1.

In the above image forming apparatus, an image is formed through the following processes as mentioned below:

1. The charging roller charges a surface of the photoconductor at a desired electrical potential.
2. An exposure device irradiates the photoconductor with image light to form an electrostatic latent image corresponding to a desired image on the photoconductor.
3. The development roller develops the electrostatic latent image with the toner to form a toner image on the photoconductor.
4. The transfer roller transfers the toner image on the photoconductor onto a recording medium.
5. The cleaning device cleans the image carrier by removing the toner which is not transferred and remains on the image carrier.
6. The recording medium on which the toner image is transferred by the transfer roller is sent to a fixing device (not shown). The fixing device fixes the toner onto the recording medium by applying heat and pressure to the toner.

The desired image is formed on a recording medium by repeating the above processes 1 to 6.

An image forming apparatus using a contact charging method in which the charging roller is brought into contact with the image carrier has been known as the image forming apparatus using such a general charging method in which the foregoing charging roller is used. Nevertheless, the image forming apparatus using the contact charging method has disadvantages as follows.

(1) A substance constituting the charging roller exudes from a charging roller and is adhered onto a surface of an image carrier to be charged, and then traces of the charging roller remain on the surface of the image carrier.
(2) When an AC voltage is applied to the charging roller, the charging roller being in contact with the image carrier vibrates. This causes charging noise sounds.
(3) Since the toner on the image carrier is adhered on the charging roller, in particular, the toner is easy to be adhered due to the above exuded substance, a charging performance of the charging roller is degraded.
(4) A substance constituting the charging roller is adhered to the image carrier.
(5) In a case where the image carrier remains out of operation for a long period of time, a permanent deformation takes place in the charging roller.

An image forming apparatus using an adjacent charging method in which the charging roller is disposed close to the photoconductor has been disclosed as techniques for solving the foregoing problems in each of Japanese Patent Application Publication Numbers Hei 3-240076, 2001-312121, and 2005-91818. In this method, the charging roller is disposed to face the photoconductor with a gap which is 50 to 300 μm as a distance between the charging roller and the photoconductor at a closest approach point, and the photoconductor is charged by applying a voltage to the charging roller. In the case of the adjacent charging method, since the charging roller is not in contact with the image carrier, the image forming apparatuses using this adjacent charging method are free from the problems occurring in image forming apparatuses using the conventional contact charging method, such as the problem of "the adherence of the substance constituting the charging roller to the image carrier" and the problem of "the permanent deformation which takes place in the charging roller in the case where the image carrier remains out of operation for a long period of time". In addition, the image forming apparatuses using the adjacent charging method are less likely to "degrade the charging performance of the charging roller due to the adherence of parts of the toner on the image carrier to the charging roller" than the image forming apparatuses using the contact charging method.

Characteristic properties required for the charging roller used in the adjacent charging method are different from those required for the charging roller used in the contact charging method. Generally the charging roller used in the contact charging method is formed by coating an elastic member such as a vulcanized rubber or the like around a core shaft. In order to charge uniformly the image carrier using such a charging roller, it is required that the charging roller should be in contact uniformly with the image carrier.

However, in a case where the charging roller formed from an elastic member such as a vulcanized rubber or the like is used in the adjacent charging method, there are such problems as listed in the following:

(1) Although it is necessary to dispose gap maintaining members such as spacers or the like at both ends of the charging roller corresponding to none image areas in order to provide a gap between the charging roller and the image carrier, it is difficult for the gap to be kept uniformly because of the deformation of the charging roller formed from the elastic member. As a result, this causes potential variation and image unevenness resulting from the potential variation.

(2) It is easy for the vulcanized rubber constituting the elastic member to become strained and deform with time, and as a result the gap varies with time.

To solve such problems it has been proposed to use a non-elastic member made of a thermoplastic resin which makes it possible to make uniform the gap between the image carrier and the charging roller.

It is known that a charging mechanism in which the surface of the image carrier (photoreceptor drum) is charged through the charging roller follows the Paschen rule within a small space between the charging roller and the image carrier in discharging. In order to keep the image carrier at a predetermined charge potential level, it is necessary to control the electrical resistance value of the thermoplastic resin within a semi conductive range of about $10^6$ to $10^9$ Ωcm.

Among methods to control the electrical resistance value of the electrical resistance adjusting layer, there is one to disperse conductive materials such as carbon blacks or the like in the thermoplastic resin. However, such a method will cause larger variation of the electrical resistance values, resulting in partial charging failure which leads to a problem of image forming failure.

Another method to control the electrical resistance value of the electrical resistance adjusting layer is to add an ion conductive material. Since such an ion conductive material may be dispersed at a molecular level in a matrix resin, the irregular variation of the electrical resistance values is smaller than that dispersed with the conductive pigments, resulting in smaller partial charging failure which will not affect the image quality. However, the ion conductive material which has a low molecular weight has a character to easily bleed out to the surface of the matrix resin. When the ion conductive material bleeds out to the surface of the charging roller, toner is adhered and fixed, leading to a problem of failure in an image formation.

In order to prevent the bleeding out of the ion conductive material, it has been proposed to use a high molecular weight ion conductive material which is dispersed and fixed in the matrix resin. In such a case, it is difficult for the high molecular weight ion conductive material to bleed out to the surface of the matrix resin. Japan Patent Number 3180861 discloses a polymeric ion conductive material having a quaternary ammonium group, which has a lesser bleeding out property with time. However, in the case of the polymeric ion conductive material, since the resistance value depends strongly on an environmental condition such as temperature and humidity, there are problems of abnormal discharge due to a low resistance value or charging failure due to a high resistance value depending on an additive rate or a condition such as temperature and humidity. In particular, image forming failure due to the abnormal discharge can easily occur under a condition of low temperature and low humidity (LL).

Furthermore, such a polymeric conductive material dispersion system in which a polymeric ion conductive material is dispersed to form a sea-island structure is disclosed, for example, in Japan Patent Application Publication Number 2005-92134. In a case where island portions of the sea-island structure are made of the polymeric ion conductive material, since a current is prevented by an insulating matrix resin, there are problems in that the resistance value of the electrical resistance adjusting layer is not reduced within the semi conductive range, or that the resistance value depends more strongly on voltage. Additionally, there are problems in that strength at a weld portion formed in molding is degraded if a size of each of the island portions is large, and that the resistance value varies. Due to this degradation of the strength, if a resin which has a low mechanical strength or resins which are not compatible with each other are used for a matrix resin, cracks at a weld portion of the electrical resistance adjusting layer, which is for example, a weld line formed in molding of the electrical resistance adjusting layer, occur due to electrical or mechanical stresses when used or volume fluctuation with time or environmental change. In addition, variation of resistance values at the weld portion, that is to say, partial unevenness of the resistance values may cause partial image failure in some cases.

SUMMARY OF THE INVENTION

An object of the present invention is to provide a conductive member having good durability, in which cracks can be prevented from occurring in use for a long time, a process cartridge having the conductive member, and an image forming apparatus having the process cartridge.

To achieve the above object, a conductive member according to an embodiment of the present invention includes a conductive support and an electrical resistance adjusting layer formed on the conductive support. The electrical resistance adjusting layer includes a thermoplastic resin, a polymeric ion conductive material, and a graft copolymer which is compatible with both of the thermoplastic resin and the polymeric ion conductive material. The electrical resistance adjusting layer is formed in a sea-island structure formed from a sea portion made of the polymeric ion conductive material and island portions made of the thermoplastic resin, the island portions being dispersed in the sea portion and formed in an elongate shape. A layer made of the graft copolymer is formed at boundaries between the thermoplastic resin and the polymeric ion conductive material.

DETAILED DESCRIPTION OF THE PREFERRED EMBODIMENTS

Preferred embodiments of a conductive member, a process cartridge and an image forming apparatus according to the present invention will be explained in detail with reference to the accompanying drawings below. The conductive member according to an embodiment of the present invention may be used in a process cartridge of an image forming apparatus such as a copying machine.

(Image Forming Apparatus)

Figure 1:
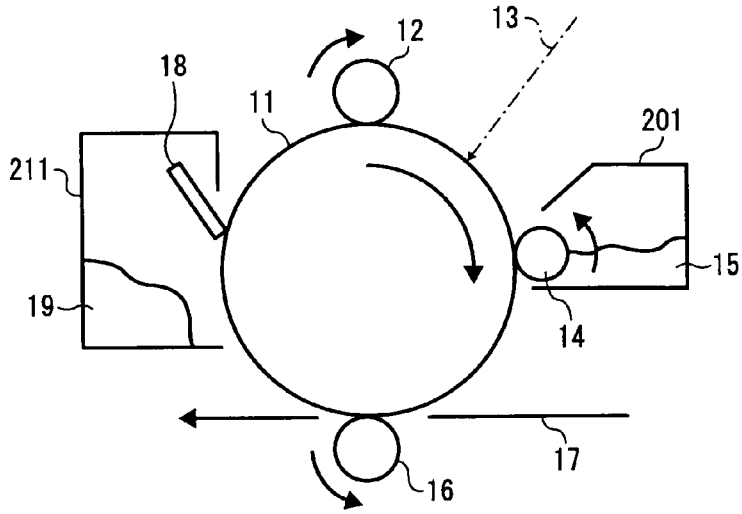
FIG. 1 PRIOR ART
FIG. 1 is a schematic view showing an image forming apparatus in an electrophotographic system.
Figure 2:
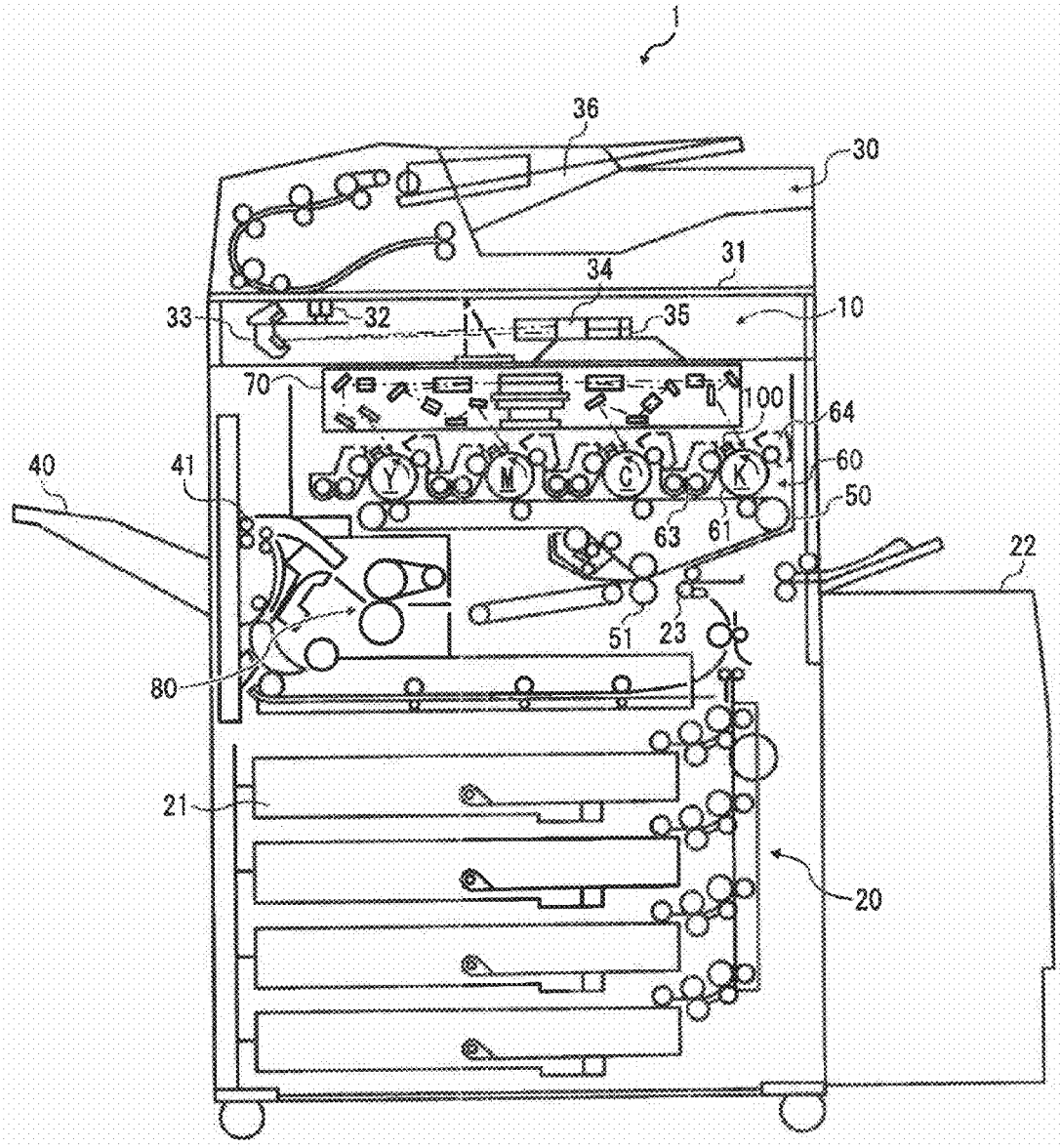
FIG. 2 is a schematic view showing a structure of an image forming apparatus having a charging device and process cartridges using a conductive member according to an embodiment of the present invention as a charging member.
Figure 3:
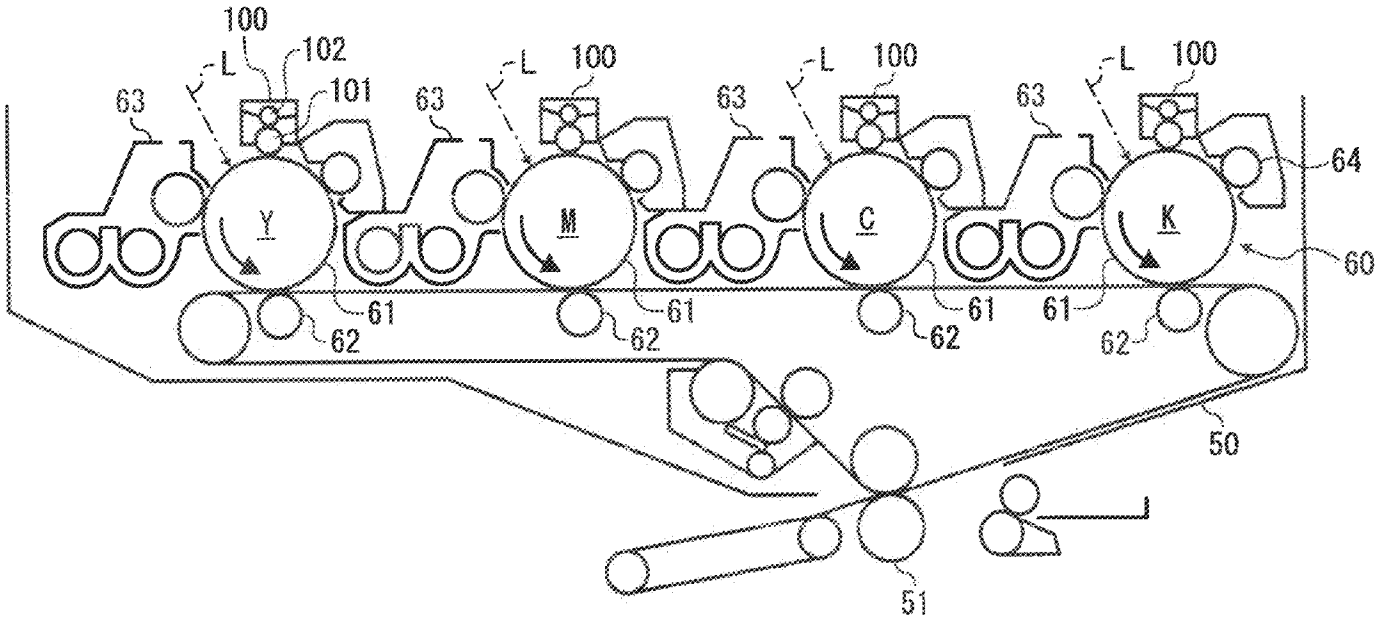
FIG. 3 is a schematic view showing a structure of an image forming section of the image forming apparatus shown in FIG. 2.

FIG. 2 is a view schematically illustrating an image forming apparatus 1 in which at least one process cartridge is used, the process cartridge having a charging device with a conductive member according to an embodiment of the present invention. FIG. 3 shows a structure of an image forming section 60 of the image forming apparatus 1 of FIG. 2. The image forming apparatus 1 has the image forming section 60 including, for example, four process cartridges corresponding to four colors of yellow (Y), magenta (M), cyan (C) and black (K), respectively and an exposure device 70. Each process cartridge has at least one charging device 100, an image carrier 61 and a cleaning device 64. A development device 63 may be included in each of the process cartridges. The image carrier 61 has, for example, a drum-shape and a photoconductive layer is formed on a surface of the image carrier. The charging device 100 is provided to charge substantially uniformly the image carrier 61, and the exposure device 70 forms an electrostatic latent image to each of the charged image carriers 61 by exposing each of the image carriers 61 with, for example, laser light. Each of the development devices 63 contains a developer of yellow, magenta, cyan, or black, respectively, corresponding its color, and forms a toner image corresponding to the electrostatic latent image on each of the image carriers 61. Each of the image carriers 61 is provided with a primary transfer device 62 to transfer the corresponding toner image on the respective image carriers 61. The image forming apparatus 1 also has an intermediary transfer body 50 which is formed in a belt-shape, and to which the toner images on the respective image carriers 61 are transferred, and a secondary transfer device 51 to which the toner images on the intermediary transfer body 50 are transferred. Each of the image carriers 61 is provided with a cleaning device 64 to remove part of the toner remaining on the image carrier 61 after the corresponding toner image is transferred to the recording medium. Recording media are transported one-by-one on a transporting channel by use of sheet feeding rollers to resist rollers 23 from one of sheet feeders 21 and 22 containing the recording media. Each recording medium is transported in synchronism with the respective image carriers 61 in order to allow the toner images on the image carriers 61 to be transferred respectively to adequate positions on the recording medium.

As shown in FIG. 2, the exposure device 70 irradiates the image carriers 61 charged by the charging devices 100 with the light to form the electrostatic latent images on the image carriers 61 which have photoconductivity. Light L may be light by a lamp such as a fluorescent lamp, a halogen lamp or the like, or laser light by a semiconductor device such as an LED (light emitting diode), an LD (laser diode), or the like. In this embodiment, the LD is used to irradiate the image carriers 61 by receiving a signal from an image processor (not shown) in synchronization with a rotational speed of each of the image carriers 61

Toner having a developer carrier and stored in the development device 63 is transported by supplying rollers to an agitation unit, where the transported toner is mixed with developer including a carrier and agitated. Subsequently, the mixture is transported to a development area opposite to the image carrier 61. The toner, which is charged with a positive or negative polarity, is transferred to the electrostatic latent image on the image carrier 61 to be developed. The developer may be a developer made of a single magnetic or nonmagnetic ingredient, a developer obtained by using both a magnetic ingredient and a non-magnetic ingredient, or a liquid developer of a wet type.

Each of the primary transfer devices 62 forms an electric field with a polarity opposite to that of the toner to transfer the toner image developed on the image carrier 61 to the intermediary transfer body 50 from backside thereof. The primary transfer device 62 may be a transfer device of a corona transfer device type such as that of corotron type or scorotron type, or a transfer device using transfer rollers, a transfer brush, or the like. Thereafter, in synchronism with a recording medium transported from the sheet feeder 22, each toner image is transferred to the recording medium by the secondary transfer device 51. It should be noted that the toner image may be directly transferred to the recording medium without using the intermediary transfer body 50.

A fixing device 80 fixes each toner image on the recording medium by heating and/or pressing. In this embodiment, the toner image is fixed by applying heat and pressure when the recording medium goes through between a pair of pressing and fixing rollers, while fusing a binding resin in the toner. The fixing device 80 may be a fixing device of a belt type instead of a fixing device of the roller type. Otherwise, the fixing device 80 may be a fixing device of a type which fixes toner images to a recording medium through thermal irradiation by using a halogen lamp or the like. The cleaning device 64 provided for the image carrier 61 removes part of the toner which has not been transferred to the recording medium, and which accordingly remains on the image carrier 61. Thereby, the cleaning device 64 enables a new toner image to be formed. The cleaning device 64 may be of a blade type which uses rubber made of urethane or the like, or of a fur brush type which uses fibers made of polyester or the like.

Operations of the image forming apparatus 1 will be explained. An original is set on an original table of an original transporting unit 36 in a reading section 30 or is set on a contact glass 31 by opening the original transporting unit 36 and subsequently closing the original transporting unit 36 to press down the original.

Once a start switch (not shown) is pushed, the original should be transported on the contact glass 31 prior to reading the original in the case where the original has been set in the original transporting unit 36. On the other hand, in a case where the original has been set on the contact glass 31, a first reading carriage 32 and a second reading carriage 33 start to run immediately to read the original.

And then, the first reading carriage 32 irradiates the original with light from a light source and reflects the light reflected on the original to the second reading carriage 33. The light reflected on the first reading carriage 32 is reflected on a mirror of the second reading carriage 33 and guided to a CCD (Charge-Coupled Device) 35 as a reading sensor via an image forming lens 34 to read image information. The read image information is sent to a control unit. The control unit irradiates the image carrier 61 with the laser L by controlling the LD, the LED or the like (not shown) provided in the exposure device 70 in the image forming section 60 based on the image information obtained from the reading section. The irradiation allows the electrostatic latent image to be formed on a surface of the image carrier 61.

A sheet feeding section 20 feeds recording media one-by-one from one of multiple sheet feeding cassettes 21 by a corresponding sheet feeding roller and separates the fed recording media and feeds each of the separated recording media to a sheet feeding channel in the image forming section 60. The image forming apparatus 1 is provided with a manual sheet-feeding tray for the manual sheet feeding on a back surface thereof. The image forming apparatus 1 is also provided with separation rollers to separate recording media on the manual sheet feeding tray one-by-one and to feed the separated recording media to a manual sheet feeding channel. Therefore, a manual sheet-feeding can be allowed to feed sheets by hand instead of by this sheet feeding section 20. The resist rollers 23 eject one-by-one recording medium stored in the sheet feeding cassette 21 to allow the recording medium to be transported to a secondary transfer portion positioned between the intermediary transfer body 50 and the secondary transfer device 51. In the image forming section 60, when the image information is received from the reading section 30, the above laser writing or the development process is performed to form the electrostatic latent image on the image carrier 61.

The developer in the development device 63 is picked up by magnetic poles (not shown) and held to form a magnetic brush on the development carrier. In addition, the developer is transferred to the image carrier 61 by applying a development bias voltage to the developer carrier to allow the electrostatic latent image on the image carrier 61 to be visible so that a toner image is formed. In the development bias voltage, an alternating-current voltage and a direct-current voltage are superimposed. One of the sheet feeding rollers in the sheet feeding section 20 is operated to feed a recording medium in a size corresponding to the toner image. With the sheet feeding, one of supporting rollers is rotationally driven by a driving motor and then the other two supporting rollers are rotated to rotate and feed the intermediary transfer body 50. At the same time, in an individual image forming unit, each of the image carriers 61 is rotated to form a single color image of a corresponding color of black, yellow, magenta, or cyan on the corresponding image carrier 61. The single color images are transferred in order to feed the intermediary transfer body 50 to form a synthetic toner image on the intermediary transfer body 50.

On the other hand, one of the sheet feeding rollers of the sheet feeding section 20 is selectively rotated and the recording media are fed from one of the sheet feeding cassettes 21. The recording media are separated and guided one-by-one to a sheet feeding pathway and guided to a pathway in the image forming section 60 of the image forming apparatus 1 by the sheet feeding rollers. Each of the recording media is stopped at the resist rollers 23.

The resist rollers 23 are rotated so as to match a timing of the synthetic toner image on the intermediary transfer body 50 and the recording medium is fed to the secondary transfer portion corresponding to a contact portion with the intermediary transfer body 50 and the secondary transfer device 51 so that the toner image is transferred on the recording media as a secondary transfer by an effect of a secondary transfer bias formed in the secondary transfer portion or a contacting pressure. The secondary transfer bias is preferably a direct-current. The recording medium on which the image has been transferred is fed to the fixing device 80 by a feeding belt of the secondary transfer device. After the toner image is fixed by applying pressure of the pressure rollers and heating in the fixing device 80, the recording medium is ejected on an ejection tray 40 by an ejecting roller 41.

(Process Cartridge)

Figure 4:
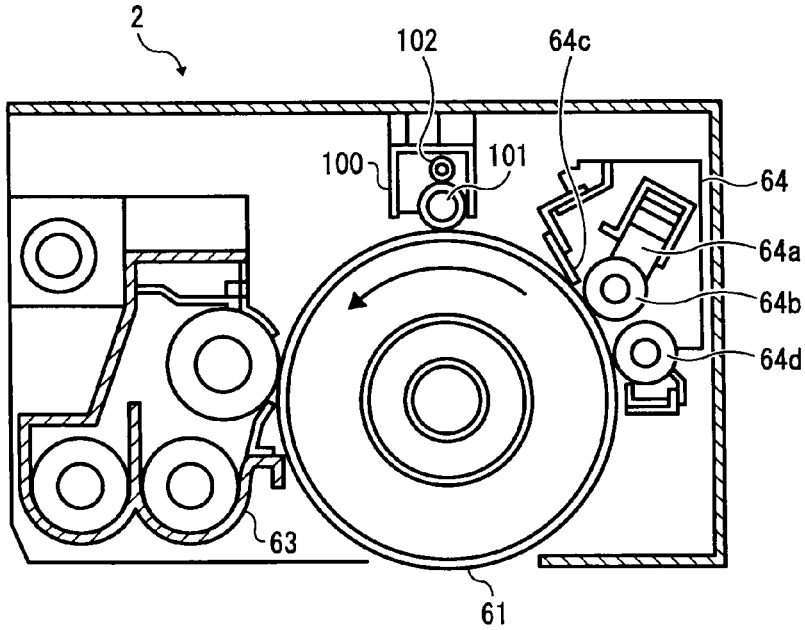
FIG. 4 is a schematic view showing a structure of a process cartridge having a charging device using a conductive member according to an embodiment of the present invention as a charging member.

The charging device 100 in which the conductive member according to an embodiment of the present invention is used as a charging member will be explained. FIG. 4 shows a structure of the charging device and the process cartridge 2 including the conductive member. The process cartridge 2 itself is detachably provided in the image forming apparatus. As illustrated in FIG. 4, a surface of the image carrier 61 is uniformly charged by the charging member disposed so as not to contact with an image forming area. An image becomes visible as a toner image by the development after a latent image is formed. The toner image is transferred on the recording medium. Toner which is not transferred on the recording medium and remains on the image carrier is recovered by an assistant cleaning member 64*d*. Then, in order to prevent attachment of the toner and materials of the toner to the image carrier 61, solid lubricant 64*a* is uniformly applied by an applying member 64*b* on the image carrier 61 to form a lubricant layer. After that, the toner which is not recovered by the assistant cleaning member 64*d* is recovered by a cleaning member 64*c* and is fed to a toner recovering portion. The assistant cleaning member is formed in a roller shape or brush shape, and the solid lubricant may be a material which can be used to reduce a friction factor of the image carrier and to allow the surface of the image carrier to be nonadhesive, for example, metallic aliphatic acid such as zinc stearate or the like, polytetrafluoroethylene, or the like. The cleaning member may be a blade of rubber made of urethane, silicon or the like, or a fur brush of fibers made of polyester or the like.

The charging device 100 is provided with a cleaning member 102 which is used to remove dust of a charging member 101. The cleaning member 102 is formed in a roller shape in this embodiment, although the cleaning member 102 may be formed in a roller shape or a pad shape. The cleaning member 102 is fitted in a bearing provided on a housing (not shown) of the charging device 100 and is rotatably supported by the bearing. The cleaning member 102 abuts with the charging member 101 to clean an external surface of the charging device 101. If the toner, paper powder (pieces of paper), breakage of certain members, or the like are attached to the surface of the charging member 101, an electric field is concentrated on the contaminating part so that abnormal electrical discharge occurs because the contaminating part is preferentially discharged. On the contrary, if electrical insulating objects are attached over a wide range of the surface of the charging member 101, charging macula is formed on the image carrier 61 because electrical discharge does not occur in areas in which charging macula is formed. Therefore, the charging device 100 is preferably provided with the cleaning member 102 to clean the surface of the charging member 101. The cleaning member may be a brush of polyester, or the like or a porous member (sponge) such as melamine resin or the like. The cleaning member may be rotated depending on the rotation of the charging member at a linear velocity, or intermittently rotated in a contact or separation manner relative to the charging member.

Furthermore, the charging device 100 includes a voltage supply for applying a voltage to the conductive member 10. The applied voltage may be only a DC voltage. It is desirable, however, that the applied voltage should be a voltage obtained by superimposing a DC voltage and an AD voltage on each other. If only the DC voltage is applied to the conductive member 101 in a case where a layer formation of the conductive member 101 is partially uneven, the electrical potential of the surface of the image carrier 61 is uneven in some cases. On the other hand, in a case where the superimposed voltage is applied to the conductive member 101, the electrical potential of the surface of the conductive member 101 can be uniformly charged. This stabilizes the electrical discharge, and accordingly makes it possible to charge the image carrier 61 uniformly. It is desirable that an interpeak voltage of the AC voltage in the superimposed voltage should be set more than twice as large as a voltage with which the image carrier 61 starts to be charged. In this respect, the voltage with which the image carrier 61 starts to be charged means an absolute value of a voltage which is applied to the image carrier 61 when the image carrier 61 starts to be electrically charged if only the DC voltage is applied to the charging member 101. Thereby, reverse discharge occurs from the image carrier 61 to the conductive member 101 so that the image carrier 61 can be uniformly charged in a more stable state due to a smoothing effect of the reverse discharge. Moreover, it is desirable that a frequency of the AD voltage should be set more than 7 times as large as a circumferential speed (process speed) of the image carrier 61. If the frequency of the AD voltage is set more than 7 times as large as the circumferential speed of the image carrier 61, this causes moiré interference patterns to be invisible.

In this embodiment of the present invention, the assistant cleaning member may be formed in a brush roller and the solid lubricant is made of a block-shaped zinc stearate. By pressing an applying roller through a pressurizing member such as a spring or the like to a brush roller which is an applying roller, a part of the solid lubricant removed by the applying roller is applied to the image carrier. A counter system is employed for the cleaning member using a urethane blade. In addition, the cleaning member of the charging member is formed by a sponge roller of melamine resin and operated in a rotating system in which the cleaning member is rotated and moved with the charging member. Therefore the surface of the charging member can be effectively cleaned.

Figure 5:
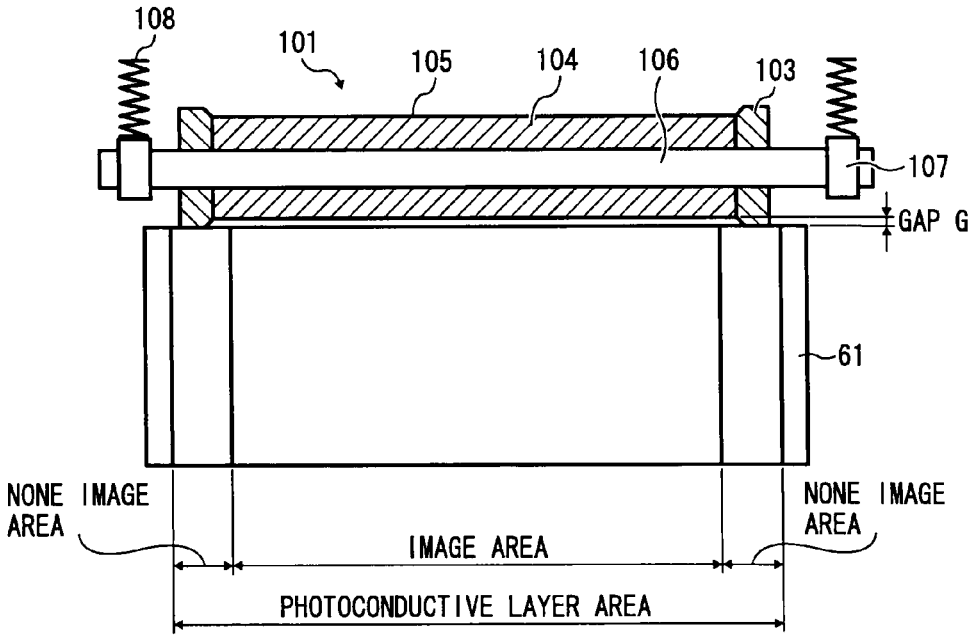
FIG. 5 is a schematic view showing a positional relationship of a charging member corresponding to a conductive member according to an embodiment of the present invention, and a photoconductive layer area, an image area, and none image areas of an image carrier.

FIG. 5 shows schematically a positional relationship of the charging member as the conductive member according to an embodiment of the present invention, a photoconductive layer area of the image carrier, an image area or a non-image area. The charging device 100 faces the image carrier 61, and includes at least the charging member 101 disposed with a small gap G, the cleaning member 102 to clean the charging member 101, the voltage supply (not shown) to apply a voltage to the charging member 101, and a pressing spring (not shown) to allow the charging member 101 to be pressed and contacted with the image carrier 61. As shown in FIGS. 4 and 5, the charging member 101 is disposed with the small gap G and faces the image carrier 61. A gap maintaining member 103 contacts with a non-image forming area of the charging member 101 so that the gap G between the charging member 101 and the image carrier 61 is formed. The gap maintaining member contacts with the photoconductive layer area so that unevenness of the gap can be prevented even though thickness of the photoconductive layer is uneven.

As shown in FIG. 5, the charging member 101 is provided with the gap maintaining members 103 disposed on both ends of an electrical resistance adjusting layer 104 formed on a conductive support 106. Moreover, a protective layer as a surface layer 105 is formed on the electrical resistance adjusting layer 104 to prevent adherence of the toner and toner additives on the charging member 101.

A shape of the charging member 101 is not limited and the charging member 101 may be formed in a belt shape, a blade (plate) shape, or a semi cylindrical shape and fixed. The charging member 101 also may be formed in a cylindrical shape and supported rotatably about a gear or a bearing at both ends of the charging member 101. As described above, if the charging member 101 has a curved surface in which a distance becomes gradually larger from a closest portion of the charging member 101, which is closest to the image carrier 61, to an upward portion of the charging device 101 and to a downward portion in a moving direction of the image carrier 61, the charging member 101 can charge more uniformly the image carrier 61. If the charging member 101 facing the image carrier 61 has a sharp-pointed portion, since discharge is preferentially started at the sharp-pointed portion to allow an electrical potential of the sharp-pointed portion to be higher, it is difficult for the image carrier 61 to be uniformly charged. Accordingly, the curved surface of the cylindrical charging member makes it possible to charge uniformly the image carrier 61. In addition, a discharging surface of the charging member 101 suffers severe stress. Since the discharging is performed in the same surface at all times, degradation of the charging member 101 is advanced and the surface is partly removed in some cases. Therefore, if all the surface of the charging member 101 can be used to discharge, this makes it possible to prevent immediate degradation so that long-lasting use can be achieved.

(Gap and Method for Producing Gap)

The gap G between the charging member 101 and the image carrier 61 is set to be not more than 100 μm, particularly within a range of approximately 5 to 70 μm by the gap maintaining member 103. Thereby, forming of an abnormal image during an operation of the charging device 100 can be prevented. In a case where the gap G is more than 100 μm, since the distance to the image carrier 61 is larger, the voltage with which the discharge starts in accordance with Paschen's law becomes larger. In addition, since a discharge space to the image carrier 61 becomes larger, a larger amount of discharge products by discharging is needed to charge the image carrier 61 in a predetermined level. Since the large amount of discharge products remains in the discharge space after forming an image, the discharge products adhere to the image carrier 61 to cause advancing time degradation of the image carrier 61. On the other hand, in a case where the gap G is smaller, the image carrier 61 is capable of being charged by use of a smaller discharged energy. However, a space formed between the charging member 101 and the image carrier 61 becomes smaller so that this worsens an air flow. For this reason, since the discharge products formed in the discharge space remains, the discharge products remain in the discharge space after forming an image so that the discharge products are adhered to the image carrier 61 causing advancing time degradation of the image carrier 61, as well as in a case where the gap is larger. Accordingly, it is preferable to reduce a discharge energy so that a small amount of the discharge products is produced and to form a space such that the air is not accumulated in the space. For instance, it is preferable that the gap G be set not larger than 100 μm, particularly between 5 and 70 μm. This setting makes it possible to prevent an abnormal discharge from occurring and to reduce the discharge products so that an amount of the discharge products which are attached on the image carrier 61 become smaller to prevent from forming images in a macular state or an image deletion.

Part of the toner which remains in the surface of the image carrier 61 after the development is removed by a cleaning device 64 provided opposite to the image carrier 61. However, it is difficult for the cleaning device 64 to remove the part of the toner completely so that an extremely small amount of the toner goes through the cleaning device 64, and thus is transported to the charging device 100. At this time, if a grain size of the toner is larger than the gap G, particles of the toner are rubbed by the image carrier 61 and the charging member 101 which rotate, and are thus heated so that the particles of the toner are fused and thus adhere to the charging member 101 in some cases. An area in which the toner is fused and adheres thereto, becomes closer to the image carrier 61 to be preferentially discharged so that abnormal discharge occurs. Therefore, the gap G is preferably larger than the maximum grain size of the toner which is used in the image forming apparatus 1.

In addition, as shown in FIGS. 4 and 5, the charging member 101 is fitted into a bearing provided on a side plate of the housing (not shown) of the charging device 100 and pressed in a direction toward the surface of the image carrier 61 by pressing springs 108 which are provided on the bearing and formed of a resin with a small coefficient of friction not to be driven by the bearing. This makes it possible to maintain the gap G constant even with mechanical vibration, or even though a core shaft of the charging member 101 deviates from a normal position. A load to press the charging member 101 is set between 4 and 25 N, preferably between 6 and 15 N. There are some cases in that even though the charging member 101 is fixed by the bearing 107, the gap G deviates from a suitable range because of vibrations due to the rotation of the charging member 101, decentering of the charging member 101, and a size change of the gap due to a convexo-concave surface of the charging member 101. Accordingly, degradation of the image carrier 61 is advanced with time. In this case, the load means all of loads applied to the image carrier 61 via the gap maintaining members 103. The load is capable of being adjusted by loads which are spring-loaded by the pressing springs 108 provided on both ends of the charging member 101, self-weights of the charging member 101 and the cleaning member 102, or the like. If the load is smaller, it is impossible to suppress the charging member 101 from changing in position due to the rotation of the charging member 61, an impact of gears in a driving operation and the like. On the other hand, if the load is larger, this increases the friction between the charging member 101 and the bearing 107 into which the charging member 101 is fitted so that an amount of abrasion of the charging member 101 is increased with time to advance a deviation of the charging member 101 from the normal position. Accordingly, it is preferable that the load be set between 4 N and 25 N, particularly between 6 N and 15 N so that the gap G is set within the adequate range. Thereby, production of the discharge products is reduced to reduce the amount of the discharge products on the image carrier 61 so that a long-lasting of the image carrier 61 can be achieved and forming abnormal images in a macular state and image deletion can be prevented.

A step is provided on a part of the gap maintaining member 103 such that a part of the gap maintaining member 103 has a height of the gap maintaining member 103 in relation to the electrical resistance adjusting layer. The gap is formed by a cutting process, such as a cutting or grinding process in which the electrical resistance adjusting layer and the gap maintaining member 103 are processed at the same time. Since the electrical resistance adjusting layer and the gap maintaining member are processed at the same time, the gap can be formed in a high accuracy.

If a height of the gap maintaining member at a part contacting with the electrical resistance adjusting layer is set to the same or less than that of the electrical resistance adjusting layer in a part, a contact width of the gap maintaining member and the photoconductor is reduced so that the gap between the conductive member and the photoconductor can be formed in a high accuracy. Thereby, an external surface of an end portion of each of the gap maintaining member, which is disposed so as to contact with the electrical resistance adjusting layer, is prevented from contacting with the image carrier and a generation of a leakage current due to the contact of the electrical resistance adjusting layer with the image carrier can be prevented. Moreover, the end portions of the gap maintaining member, which contacts with the electrical resistance adjusting layer are processed to allow the height of the end portions to be lower than that of the gap maintaining portions so that clearances (process clearance) for a cutting blade during a removing process can be formed. In addition, the clearance may be formed in any shapes if the external surface of the end portions of the gap maintaining member is not contacted with the image carrier.

Furthermore, it is difficult to perform a masking on boundaries between the electrical resistance adjusting layer and the gap maintaining member during formation of a surface layer without unevenness. Therefore, if the gap maintaining members are processed so as to have a height which is the same or less than the electrical resistance adjusting layer, a surface layer is formed even on the gap maintaining member as well as on the electrical resistance adjusting layer. Consequently, the surface layer can be reliably formed on the electrical resistance adjusting layer.

(Gap Maintaining Member)

The gap maintaining member 103 is required to be configured to form the gap to the photoconductor stably for a long period of time in use and under various conditions. For this reason, the gap maintaining member is preferably formed from a material having a high hygroscopic property and a high abrasion quality. In addition, it is advantageous that the gap maintaining member is configured to allow toner and toner additives to be hardly adhered thereon and to allow the photoconductor to be abraded due to sliding of the gap maintaining member on the photoconductor. Therefore the gap maintaining member is formed according to each of required conditions. More particularly, the gap maintaining member is formed of commodity resin such as polyethylene (PE), polypropylene (PP), polyoxymethylene (POM), polymethylmethacrylate (PMMA), polystyrene (PS) and copolymer (AS, ABS) thereof, polycarbonate (PC), urethane resin, polytetrafluoroethylene or the like. In particular, in order to reliably fix the gap maintaining member, an adhesive may be applied. Moreover, the gap maintaining member is preferably formed from insulating materials, that is to say, a volume resistivity value is over $10^{13}$ Ωcm. The insulating materials can prevent the generation of the leakage current with the photoconductor. The gap maintaining member according to an embodiment of the present invention is molded in a molding process.

(Electrical Resistance Adjusting Layer)

A volume resistivity value of the electrical resistance adjusting layer is preferably between $10^6$ and $10^9$ Ωcm. If the value is over $10^9$ Ωcm, charging ability or transferring ability are insufficient. On the other hand, if the value is less than $10^6$ Ωcm, leaks by concentrating the voltage are generated over the photoconductor.

The electrical resistance adjusting layer is formed from a sea-island structure formed from a sea portion made of a polymeric ion conductive material and island portions made of a thermoplastic resin which is dispersed in the sea portion of the polymeric ion conductive material. A layer of a graft copolymer which is compatible with both of the thermoplastic resin and the polymeric ion conductive material is formed at boundaries between the sea portion and the island portions. Due to this structure, both of the thermoplastic resin of the island portions and the polymeric conductive material of the sea portion contribute to advancements of mechanical properties of the electrical resistance adjusting layer and mechanical properties which are not obtained due to conventional simple sea-island structures are obtained.

Furthermore, it is found that depending on a shape of island portions, durability to cracks which occur in the electrical resistance adjusting layer varies. That is to say, in a case where each of the island portions is formed in an elongate shape, in particular, in an axial direction of the conductive member, cracks can be more effectively prevented from occurring in the electrical resistance adjusting layer.

More particularly, the electrical resistance adjusting layer is required to be formed from a resin including polycarbonate, polyether-ester-amide, and a graft copolymer which is compatible with both of the polycarbonate and the polyether-ester-amide. The electrical resistance adjusting layer is formed in a sea-island structure formed from a sea portion made of the polyether-ester-amide and island portions made of the polycarbonate, the island portions being dispersed in the sea portion and formed in an elongate shape, and a layer made of the graft copolymer is formed at boundaries between the island portions and the sea portion is formed.

The polycarbonate as a thermoplastic resin is a resin including a carbonate ester structure in a structural unit and being formed from polymer shown in a formula (I) where each of $R^1$, $R^2$ is a hydrogen atom or a methyl group and n is a natural number, which is a known resin. Since an intermolecular attractive force due to carbonates formed by a carbonyl group and a dioxy group in the polymer is extremely strong, the polycarbonate is advantageous in mechanical strength, creep property, and the like. In particular, shock strength property of the polycarbonate is far more advantageous than that of the other thermoplastics.

(I)

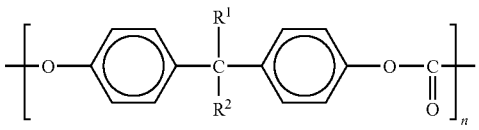

On the other hand, the polyether-ester-amide as a polymeric ion conductive material is a copolymer shown in a formula (II) where each of $R^1$, $R^2$, $R^3$ is an alkyl group with a carbon number of 1 to 20 and 1 is a natural number. The polyether-ester-amide is formed from a hard portion of a polyamide unit and a soft portion of a polyether unit and is a known copolymer. Since the polyether-ester-amide is a polymeric ion conductive material, conductive portions are dispersed at the molecular level and fixed in a matrix polymer so that partial unevenness of electrical resistance values does not occur because of dispersing failure which occurs in a material in which a conductive agent of an electron conduction type such as metallic oxide, carbon black, or the like is dispersed. Moreover, if a high voltage is applied to the conductive member using the conductive agent of the electron conduction type, flow paths in which electricity is preferably carried are locally formed so that a leakage current to the image carrier is generated. In particular, if this type of charging member is used in the image forming apparatus, abnormal images such as white or black macular images are formed. However, in the case of the polyether-ester-amide, bleeding out of the conductive portions does not occur so that formation of abnormal images can be prevented.

(II)

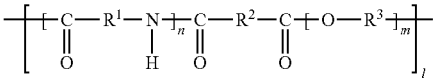

In addition, in order further to adjust the resistance value, an electrolyte (salt), for example, alkali metal salt such as sodium perchlorate, lithium perchlorate, or the like, or quaternary phosphonium salt such as ethyl-triphenylphosphonium tetrafluoroborate, tetraphenylphosphonium bromide, or the like may be added. A conductive agent may be used solely, or multiple conductive agents may be used by blending, as long as such a use does not deteriorate the properties.

The graft copolymer which is compatible with both of the polycarbonate and the polyether-ester-amide is for example a copolymer shown in a formula (III) where each of n, m, 1 is natural number. The graft copolymer includes polycarbonate as a main chain and acrylonitrile-styrene-glycidyl methacrylate copolymer as a sub chain. Since the graft copolymer is configured in a molecular structure such that the polycarbonate as the main chain of the graft copolymer has the sub chain of the dioxy group as a polar group, intermolecular attractive force is extremely strong. Therefore, due to such a main chain, the graft copolymer is advantageous in mechanical strength, creep property, and the like. In particular, shock strength property of the graft copolymer is far more advantageous than that of the other thermoplastics. In addition, since the graft copolymer has a comparably low water absorption rate, volume fluctuation with water absorption fluctuation is comparably less.

Due to these properties, in a case where the polycarbonate is used as the main chain of the graft copolymer, generation of cracks due to mechanical or electrical stress when used or volume fluctuation with time or environmental change are prevented.

(III)

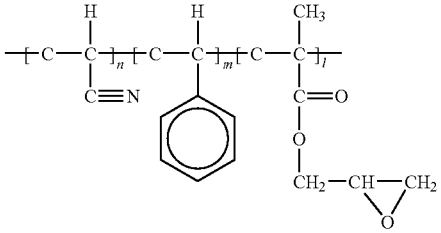

Furthermore, the acrylonitrile-styrene-glycidyl methacrylate copolymer as the sub chain is formed from an acrylonitrile component, styrene component, and glycidyl methacrylate component which is a reactive group. The reactive group, that is the glycidyl methacrylate has an epoxy group which reacts with an ester group or an amino group of the polyether-ester-amide and forms a strong chemical bond with the polyether-ester-amide with heat during melting and kneading of these components. In addition, the acrylonitrile component and the styrene component are compatible with the polycarbonate. Accordingly, the graft copolymer shown in a formula (III) functions as a compatibilizer between the polycarbonate and polyether-ester-amide, which are naturally incompatible with each other, and allows the polycarbonate and polyether-ester-amide to be uniformly and finely dispersed in each other.

Due to the function of the graft copolymer which is compatible with both of the polycarbonate and the polyether-ester-amide, by melting and kneading these three components, that is to say, the polycarbonate as a thermoplastic resin, the polyether-ester-amide as a polymeric ion conductive material, and the graft copolymer, a sea-island structure which is formed from a sea portion made of the polyether-ester-amide and island portions made of the polycarbonate, and in which the island portions are dispersed in the sea portion and formed in an elongate shape is formed. A layer made of the graft copolymer is formed at boundaries between polycarbonate and the polyether-ester-amide is formed. Thereby, fluctuation of a resistance at a weld portion and generation of cracks at the weld portion because of mechanical or electrical stress when used or volume fluctuation with time or environmental change with fault of dispersion of the polycarbonate in the polyether-ester-amide can be prevented. As a result, a resin composition which has a good mechanical strength with effects of the above polycarbonate as the main chain, can be formed by melting and kneading.

The resin composition constituting the electrical resistance adjusting layer is capable of being easily produced by melting and kneading the mixture of the polycarbonate, the polyether-ester-amide, and the graft copolymer by use of a biaxial kneader, another type of kneader or the like. By heating during melting and kneading, a glycidyl portion of the graft copolymer is bonded with the ester group or the amino group of the polyether-ester-amide, and each component of the polycarbonate, the polyether-ester-amide, and the graft copolymer is uniformly dispersed in each other. At this time, when a sum of a ratio of the polycarbonate and a ratio of the polyether-ester-amide is 100 parts by weight, the ratio of the polyether-ester-amide is required to be 20 to 90 parts by weight. If the ratio of the polyether-ester-amide is less than 20, a sufficient conductivity can not be obtained in some cases. On the other hand, if the ratio is more than 90, a sufficient strength for the electrical resistance adjusting layer can not be obtained in some cases. The ratio of the polyether-ester-amide is preferably 50 to 90 parts by weight to form the sea-island structure which is formed from the sea portion of the polyether-ester-amide and the island portions of the polycarbonate and in which the island portions are formed in an elongate shape.

A ratio of the graft copolymer which is compatible with the polycarbonate and the polyether-ester-amide is 1 to 15 parts by weight when the sum of a ratio of the polycarbonate and a ratio of the polyether-ester-amide is 100 parts by weight. Thereby, as described above, compatibility of the polycarbonate with the polyether-ester-amide can be enhanced so that excellent process stabilities can be obtained and that a required diameter or size of each of the island portions can be obtained.

The electrical resistance adjusting layer can be easily formed on a conductive support by coating the conductive support with the semiconductor resin composition of the polycarbonate, the polyether-ester-amide, and the graft copolymer by use of extrusion molding, injection molding or the like. In a case where the conductive member is formed in an elongated shape in an axial direction of the conductive member, the island portions are oriented in the axial direction of the conductive member by flowing the resin composition in the axial direction of the conductive member.

Figure 6A:
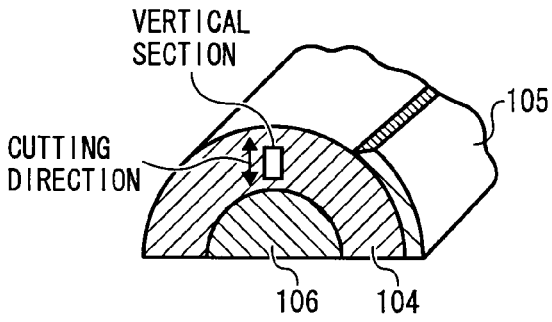
FIG. 6A is a view showing a method for cutting out in a section vertical to an axial direction of the conductive member.
Figure 6B:
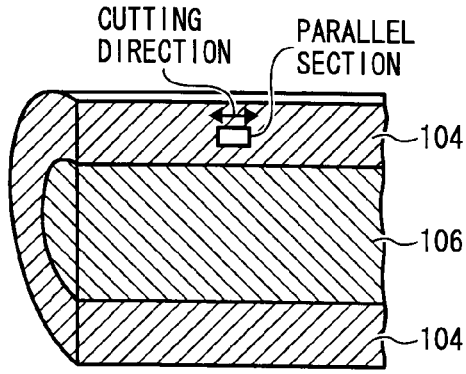
FIG. 6B is a view showing a method for cutting out in a section parallel to the axial direction of the conductive member.
Figure 7:
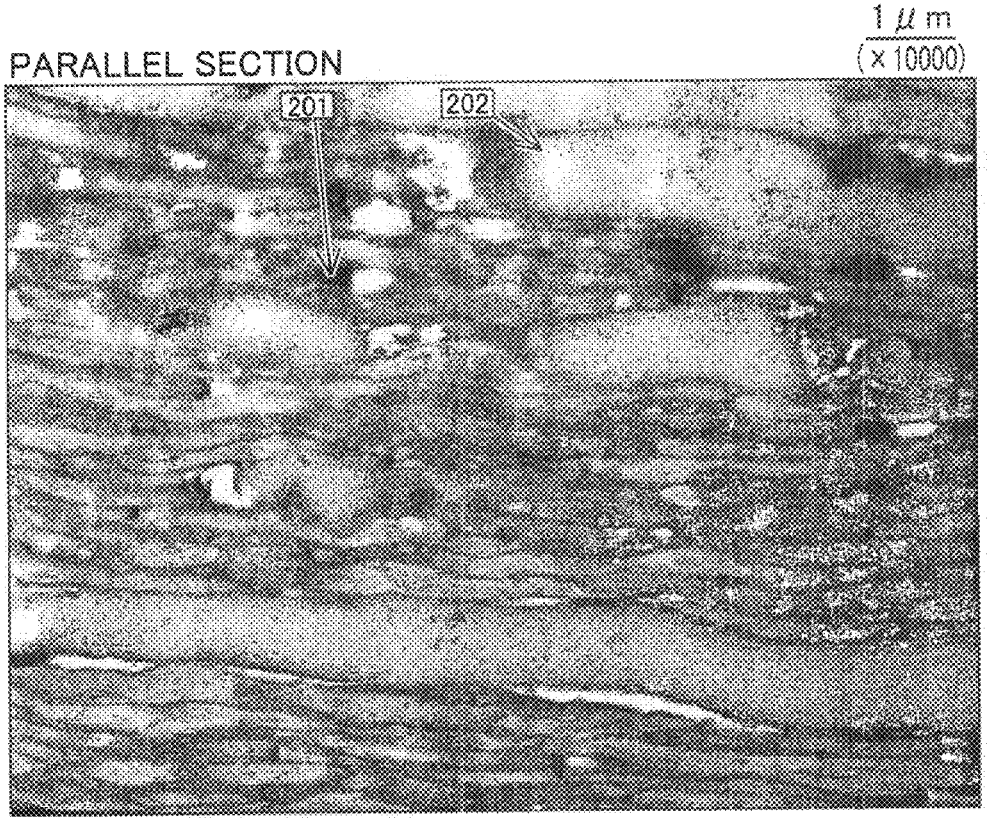
FIG. 7 is an example of a photograph of an electrical resistance adjusting layer of the conductive member, which is micrographed by a transmission electron microscope in a section parallel to the axial direction of the conductive member.
Figure 8:
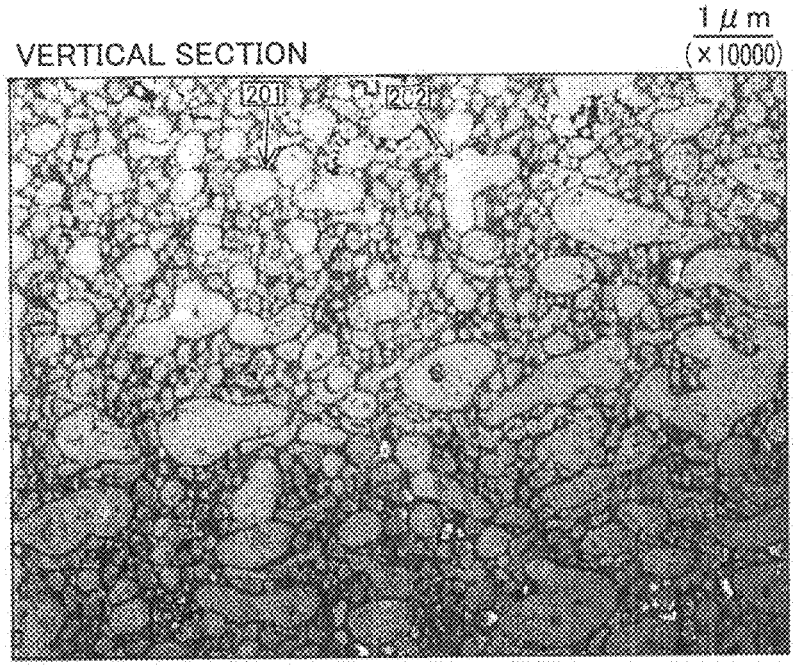
FIG. 8 is an example of a photograph of an electrical resistance adjusting layer of the conductive member, which is micrographed by a transmission electron microscope in a section vertical to the axial direction of the conductive member.

A dispersion state of the resin composition in the electrical resistance adjusting layer formed on the conductive support is observed as described below. The electrical resistance adjusting layer is cut in section and after being embedded in an epoxy resin, a super thin piece of a thickness of about 50 nm cut by use of a cryomicrotome. The super thin piece is dyed with osmium tetroxide, ruthenium tetroxide, or the like, as needed, and then observed by a transmission electron microscope. An example of a method for cutting the electrical resistance adjusting layer and obtaining a section of the electrical resistance adjusting layer is shown in FIGS. 6A and 6B, and obtained photographs are shown in FIGS. 7 and 8. FIG. 7 shows a photograph micrographed by a transmission electron microscope in a section parallel to the axial direction of the conductive member. Reference numbers 201 and 202 indicate a sea portion and a island portion, respectively. FIG. 8 shows a photograph micrographed by the transmission electron microscope in a section vertical to the axial direction of the conductive member. From these cut sections of the electrical resistance adjusting layer, it was found that the island portions are formed in an elongate shape and oriented in the axial direction of the conductive member.

Figure 9:
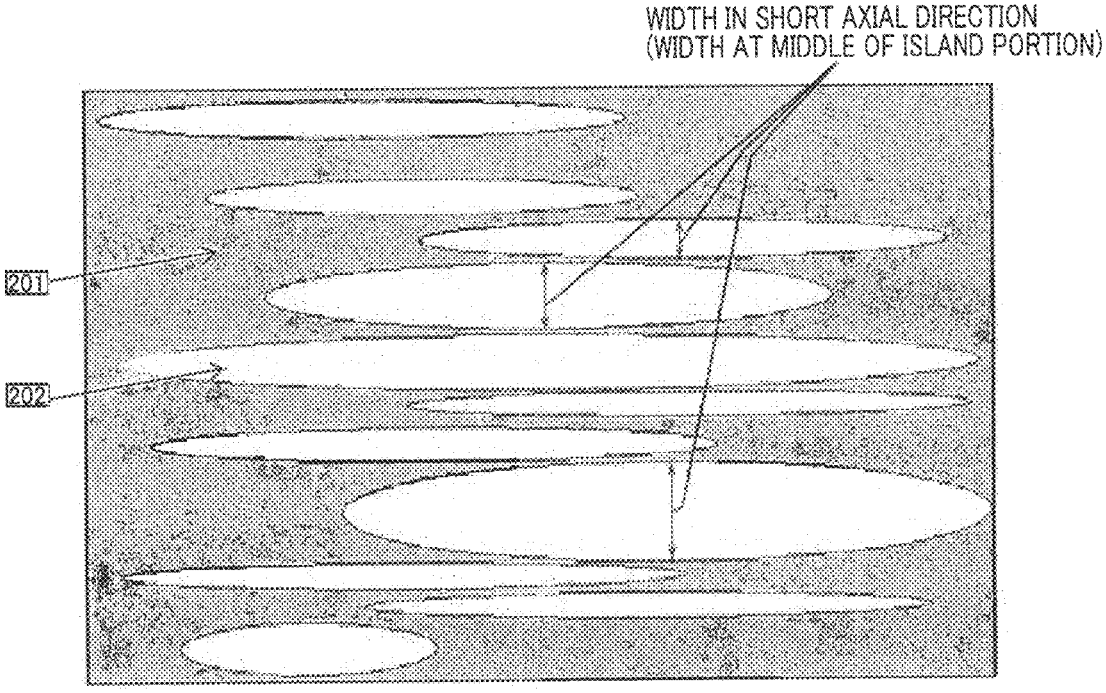
FIG. 9 is a view showing a method to measure a width of an island portion in a short axial direction of the island portion.

A width in a short axial direction of each of any 100 islands in the photograph is measured and a mean value of the width values was calculated. The width of each of the island portions was obtained at a middle of the island portion as schematically shown in FIG. 9. The width in the short axial direction of the island portion is preferably 10 μm or less. If the width is more than 10 μm, a charging failure due to bleeding out occurs in some cases.

Moreover, in order to make the width of the island portion to be 10 μm or less, a gate portion is provided near one end of a core shaft to be coated by the electrical resistance adjusting layer when an injection molding of the electrical resistance adjusting layer, and the melt resin composition is introduced from the gate into a cavity provided around the core shaft.

If the conductive member in which only the electrical resistance adjusting layer is formed on the conductive support is used as a charging body in an image forming apparatus, toner and toner additives may be adhered and fixed on the electrical resistance adjusting layer in some cases. The failure can be prevented by forming a surface layer on the electrical resistance adjusting layer.

A resistance value of the surface layer is set so as to be larger than that of the electrical resistance adjusting layer so that concentration of a voltage or abnormal discharge (leak) on a defective site of the photoconductor can be prevented. However, if the resistance value of the surface layer is too high, discharge ability or transfer ability is missed. Therefore, difference between the resistance values of the surface layer and the electrical resistance adjusting layer is preferably $10^3$ Ωcm or less.

(Surface Layer)

It is preferable that a material used to form the surface layer should be a resin such as a fluoride-based resin, a silicone-based resin, polyamide resin, polyester resin, or the like which have a better non-adhesive property to prevent the toner from adhering and fixing on the surface layer. The surface layer is formed on the electrical resistance adjusting layer in the following manner. First of all, a resin material used to form the surface layer is dissolved in an organic solvent to produce a coating, and then the electrical resistance adjusting layer is coated with the coating by spray coating, dipping, roll coating or the like. It is desirable that the surface layer is set at 10 to 30 μm in thickness.

Any one of a single type or a binary type of liquid coating may be used as a coating used to form the surface layer. If a binary type of liquid coating in which a curing agent is used with a base agent is employed, this employment makes it possible to enhance the environmental resistance, non-adhesive property, and mold release property of the surface layer. In a case where the binary type of liquid coating is employed, a general practice is to heat the coated film, thereby crosslinking and hardening the resin constituting the coated film. However, the coated film can not be heated at a high temperature, because the electrical resistance adjusting layer is formed of the thermoplastic resin. For this reason, a binary type of liquid coating is used which is made of a base agent containing a hydroxyl group in its molecule and an isocyanate-based resin allowing a crosslinking reaction with the hydroxyl group. By using the isocyanate-based resin, crosslinking and curing reactions are undergone at a relatively low temperature of not higher than 100° C. As a result of consideration from the non-adhesive property with the toner, it is found that the silicone-based resin, in particular, an acrylic silicone resin having a acrylic backbone in its molecule has a high non-adhesive property.

Since an important factor of the conductive member is its electrical characteristic (resistance value), it is necessary that the surface layer should be conductive. The conductivity of the surface layer is formed by dispersing a conductive agent in the resin material used to form the surface layer. No specific restriction is imposed on the conductive agent. Examples of the conductive agent include: conductive carbons such as a Ketjen black EC and an acetylene black; carbons for rubber such as SAF (Super Abrasion Furnace), ISAF (Intermediate SAF), HAF (High Abrasion Furnace), FEF (Fast Extruding Furnace), GPF (General Purpose Furnace), SRF (Semi-Reinforcing Furnace), FT (Fine Thermal), MT (Medium Thermal); carbons for color to which an oxidation treatment or the like has been applied; pyrolytic carbon; tin oxide doped with indium (ITO); metal single bodies such as copper, silver and germanium; metal oxides such as tin oxide, titanium oxide and zinc oxide; and conductive polymers such as polyaniline, polypyrrole and polyacetylene. As the conductivity-imparting agents, there may be used ionic conductive agents. Examples of the ionic conductive agents include: inorganic ionic conductive substances such as sodium perchlorate, lithium perchlorate, calcium perchlorate and lithium chloride; and organic ionic conductive substances such as quaternary phosphonium salt such as ethyl-triphenylphosphonium tetrafluoroborate, tetraphenylphosphonium bromide, aliphatic acid-modified dimethylammonium etho-sulfate, ammonium stearate acetate, lauryl ammonium acetate.

The conductive agents may be used singly or in combination by blending, as long as such a use does not deteriorate the properties. The conductive agents can be dispersed in the resin material by use of a publicly-known method using a dispersing medium such as glass beads or zirconia beads in a ball mill, paint shaker or beads mill.

Examples according to embodiments of the present invention will be explained below.

EXAMPLE 1

A mixture of 100 parts by weight of polycarbonate (PANLITE L-1255LL, Teijin Kasei Co.) of 20 parts by weight and polyether-ester-amide (IRGASTAT P18, Ciba Specialty Chemicals Co., Ltd) of 80 parts by weight and polycarbonate-glycidyl methacrylate-styrene-acrylonitrile copolymer (MODIPER C L440-G, Nippon Yushi Co., Ltd.) of 4.5 parts by weight were mixed. The mixture was melted and kneaded in an extruding and kneading machine set at 220° C. to form a resin composition (volume resistivity value is $2\times10^8$ Ωcm). A surface of a core shaft made of stainless steel as a conductive support which has an external diameter of 8 mm and a length of 34 cm was coated with the melt resin composition except surfaces of each of end portions, that is to say, about 2 cm from each end of the core shaft so that the electrical resistance adjusting layer was formed. The melt resin composition during molding was flowed in an axial direction of the conductive support (in an axial direction of the core shaft). That is to say, in particular, a die provided with a gate portion disposed near one end of the core shaft when molding of the electrical resistance adjusting layer was used and the electrical resistance adjusting layer was molded by introducing the melt resin composition from the gate portion into the cavity disposed around the core shaft.

Then, ring-shaped gap maintaining members made of high-density polyethylene resin (Novatec HD HY540, Japan Polyethylene Corporation) were put on the both end portions of the core shaft and bonded to the core shaft and end portions of the electrical resistance adjusting layer. Surfaces of the gap maintaining members and the electrical resistance adjusting member were processed to allow an external diameter of the gap maintaining member to be set to 12.12 mm and an external diameter of the electrical resistance adjusting layer to be set to 12.00 mm by a cutting process at the same time.

A surface of the electrical resistance adjusting layer formed above was coated with a mixture (volume resistivity value: $2\times10^9$ Ωcm) of an acryl silicon resin (3000VH-P, KAWAKAMI Paint Corporation), an isocyanate-based curing agent, and carbon black (35 weight % to a total dissolved solid) to form the surface layer of 10 μm in thickness. The surface layer was processed by a calcination process in which a resin to form the surface layer was thermally-cured to form a conductive member with the surface layer.

Figure 10:
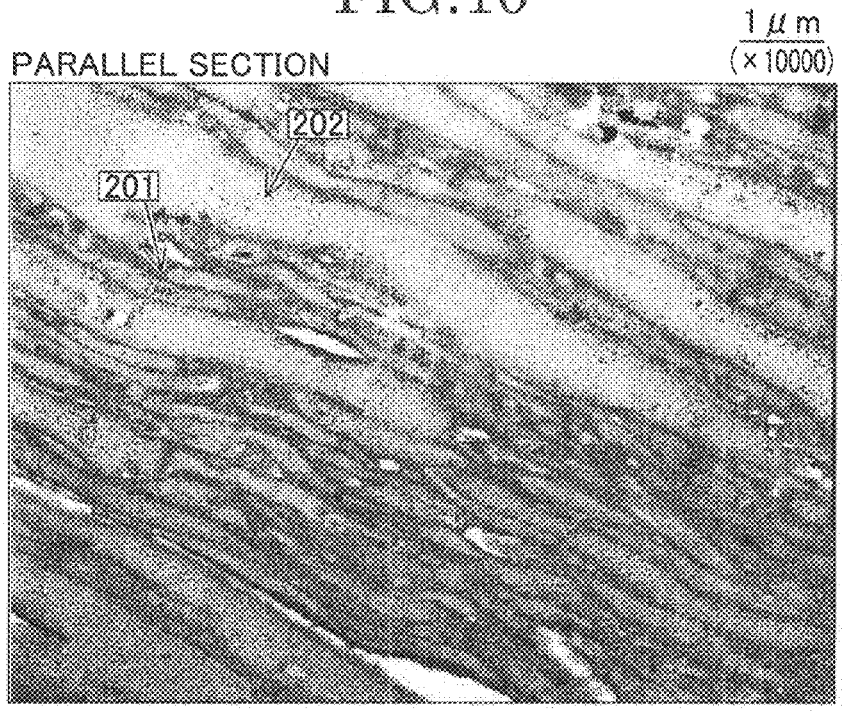
FIG. 10 is a photograph of the electrical resistance adjusting layer micrographed by a transmission electron microscope in a section parallel to an axial direction of the conductive member of an example 1.
Figure 11:
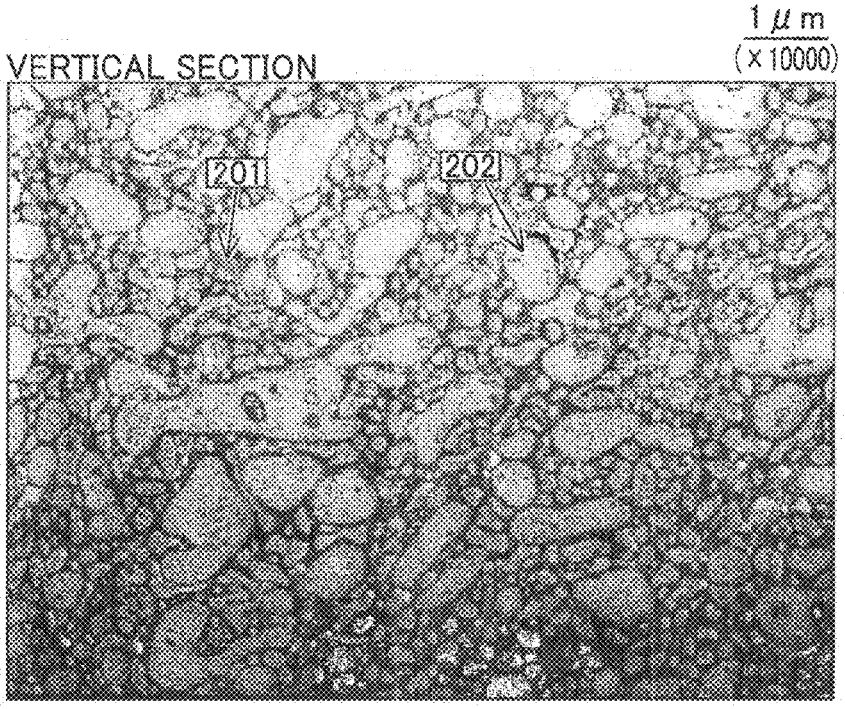
FIG. 11 is a photograph of the electrical resistance adjusting layer micrographed by a transmission electron microscope in a section vertical to an axial direction of the conductive member of an example 2.

The electrical resistance adjusting layer of the conductive member was cut in a section vertical and parallel to the axial direction of the core shaft and in a section as shown in FIG. 6, and then after being embedded with an epoxy resin, super thin pieces of 50 nm in thickness were formed by use of a cryo-microtome, respectively. The super thin pieces were dyed with ruthenium tetroxide or the like and then observed by a transmission electron microscope. Photographs micrographed in a vertical section and parallel section to the core shaft are shown in FIGS. 10 and 11, respectively. It is found that a sea-island structure, which was formed from a sea portion of the polyether-ester-amide and island portions of the polycarbonate, and in which a long axial direction of each of the island portions was oriented in the axial direction of the core shaft of the conductive member was formed. A width in a short axial direction of each of the island portions was almost 10 μm or less (mostly 3 μm or less).

EXAMPLE 2

The conductive member was obtained as described in the above Example 1 except that the polycarbonate-glycidyl methacrylate-styrene-acrylonitrile copolymer of 12 parts by weight was used in relation to the polycarbonate of 20 parts by weight and the polyether-ester-amide of 80 parts by weight.

The electrical resistance adjusting layer was observed by a transmission electron microscope, and it is found that a sea-island structure, which was formed from a sea portion of the polyether-ester-amide and island portions of the polycarbonate, and in which a long axial direction of each of the island portions was oriented in the axial direction of the core shaft of the conductive member was formed. A width in a short axial direction of each of the island portions was almost 10 μm or less (mostly 5 μm or less).

EXAMPLE 3

The conductive member was obtained as described in the above Example 1 except that polycarbonate Iupilon H-4000 manufactured by Mitsubishi Engineering-Plastics Corporation was used instead of the polycarbonate PANLITE L-1255LL manufactured by Teijin Kasei Co.

The electrical resistance adjusting layer was observed by a transmission electron microscope, and it is found that a sea-island structure, which was formed from a sea portion of the polyether-ester-amide and island portions of the polycarbonate, and in which a long axial direction of each of the island portions was oriented in the axial direction of the core shaft of the conductive member was formed. A width (mean value) in a short axial direction of each of the island portions was almost 10 μm or less (mostly 5 μm or less).

EXAMPLE 4

The conductive member with the surface layer was obtained as described in the above Example 1 except that the polycarbonate of 10 parts by weight, the polyether-ester-amide of 90 parts by weight, and polycarbonate-glycidyl methacrylate-styrene-acrylonitrile copolymer of 9 parts by weight were mixed and melted and kneaded at 210° C.

The electrical resistance adjusting layer was observed by a transmission electron microscope, and it is found that a sea-island structure, which was formed from a sea portion of the polyether-ester-amide and island portions of the polycarbonate, and in which a long axial direction of each of the island portions was oriented in the long axial direction of the core shaft of the conductive member was formed. A width (mean value) in a short axial direction of each of the island portions was almost 10 μm or less (mostly 3 μm or less).

EXAMPLE 5

The conductive member with the surface layer was obtained as described in the above Example 1 except that the polycarbonate of 20 parts by weight, the polyether-ester-amide of 80 parts by weight, and polycarbonate-glycidyl methacrylate-styrene-acrylonitrile copolymer of 9 parts by weight were mixed and melted and kneaded at 230° C.

The electrical resistance adjusting layer was observed by a transmission electron microscope, and it is found that a sea-island structure, which was formed from a sea portion of the polyether-ester-amide and island portions of the polycarbonate, and in which a long axial direction of each of the island portions was oriented in the long axial direction of the core shaft of the conductive member was formed. A width (mean value) in a short axial direction of each of the island portions was almost 10 μm or less (mostly 3 μm or less).

COMPARATIVE EXAMPLE 1

A mixture of a polymeric conductive material having polyether component (AQUA CALK TW, SUMITOMO SEIKA CHEMICALS CO., LTD.) of 30 parts by weight and polypropylene resin (Novatec PP MA3, Japan Polypropylene Corporation) of 70 parts by weight was preliminarily molded by extrusion molding without melting and kneading. The molded resin composition to form an electrical resistance adjusting layer was fixed by use of a conductive adhesive on a surface of a core shaft made of stainless steel as a conductive support, which has an external diameter of 8 mm and is the same as that used in the examples, except surfaces of each of end portions of the core shaft, that is to say, about 2 cm from each end of the core.

Then, ring-shaped gap maintaining members made of high-density polyethylene resin were put on the both end portions of the core shaft and bonded to the core shaft and end portions of the electrical resistance adjusting layer. Surfaces of the gap maintaining members and the electrical resistance adjusting member were processed to allow an external diameter (maximum diameter) of the gap maintaining member to be set to 12.12 mm and an external diameter of the electrical resistance adjusting layer to be set to 12.00 mm by a cutting process at the same time.

The electrical resistance adjusting layer was observed by a transmission electron microscope, and it is found that a sea-island structure, which was formed from a sea portion of the polypropylene and island portions of the polymeric conductive material, and which are dispersed in the sea portion was formed. A diameter of each of island portions was almost 100 to 200 μm. Each of the island portions was substantially in a round shape and was not oriented in any directions.

COMPARATIVE EXAMPLE 2

A mixture of ion conductive polymer compound having quaternary ammonium base (Leox AS-1720, Dai-ichi Kogyo Seiyaku Co., Ltd.) of 30 parts by weight and polypropylene resin (MA3, Japan Polypropylene Corporation) of 70 parts by weight was preliminarily molded by extrusion molding without melting and kneading. The molded resin composition to form an electrical resistance adjusting layer was fixed by use of a conductive adhesive on a surface of a core shaft made of stainless steel as a conductive support, which has an external diameter of 8 mm, except surfaces of each of end portions of the core shaft, that is to say, about 2 cm from each end of the core.

Then, ring-shaped gap maintaining members made of polyamide resin were put on the both end portions of the core shaft and bonded to the core shaft and end portions of the electrical resistance adjusting layer. Surfaces of the gap maintaining members and the electrical resistance adjusting member were processed to allow an external diameter (maximum diameter) of the gap maintaining member to be set to 12.12 mm and an external diameter of the electrical resistance adjusting layer to be set to 12.00 mm by cutting process at the same time.

The electrical resistance adjusting layer was observed by a transmission electron microscope, and it is found that a sea-island structure, which was formed from a sea portion of the polypropylene and island portions of the ion conductive polymer compound, and which are dispersed in the sea portion was formed. A diameter of each of island portions was almost 200 to 300 μm. Each of the island portions was substantially in a round shape and was not oriented in any directions.

COMPARATIVE EXAMPLE 3

A resin composition in which conductive carbon black (KETJENBLACK EC, Ketjen Black International Company Ltd.) of 15 parts by weight was added in polypropylene resin (MA3, Japan Polypropylene Corporation) of 100 parts by weight was preliminarily molded by extrusion molding without melting and kneading. The molded resin composition to form an electrical resistance adjusting layer was fixed by use of a conductive adhesive on a surface of a core shaft made of stainless steel as a conductive support, which has an external diameter of 8 mm, except surfaces of each of end portions of the core shaft, that is to say, about 2 cm from each end of the core.

A surface of the electrical resistance adjusting member was processed to allow an external diameter of the electrical resistance adjusting layer to be set to 12.00 mm by a cutting process. Then, tape-shaped members (Daitac PF025-H, Dai Nippon Ink Co.) of 50 μm in thickness were coated to both end portions of the electrical resistance adjusting layer by use of a one-component epoxy resin adhesive (2202, ThreeBond Co. Ltd.), so that a conductive member was obtained.

The electrical resistance adjusting layer was observed by a transmission electron microscope, and a sea-island structure was not observed.

COMPARATIVE EXAMPLE 4

A resin composition in which lithium perchlorate of 2 parts by weight was added in polypropylene resin (MA3, Japan Polypropylene Corporation) of 100 parts by weight was preliminarily molded by extrusion molding without melting and kneading. The molded resin composition to form an electrical resistance adjusting layer was fixed by use of a conductive adhesive on a surface of a core shaft made of stainless steel as a conductive support, which has an external diameter of 8 mm, except surfaces of each of end portions of the core shaft, that is to say, about 2 cm from each end of the core.

Then, ring-shaped gap maintaining members made of polyacetal resin (Duracon YF10, Polyplastics Co., Ltd.) were put on both end portions of the core shaft and bonded to the core shaft and end portions of the electrical resistance adjusting layer. Surfaces of the gap maintaining members and a surface of the electrical resistance adjusting member were processed to allow an external diameter (maximum diameter) of the gap maintaining member to be set to 12.12 mm and an external diameter of the electrical resistance adjusting layer to be set to 12.00 mm by a cutting process at the same time so that a conductive member was obtained.

The electrical resistance adjusting layer was observed by a transmission electron microscope, and a sea-island structure was not observed.

(Evaluation)

The conductive member of each of the above Examples 1 to 5 and the Comparative Examples 1 to 4 was evaluated by methods of Tests 1 and 2 for durability as described below.

(Test 1)

The image forming apparatus shown in FIG. 2 was used as an acceleration test device. The above-described conductive member was mounted as a charging member (charging roller) and copy idling tests in which the image forming apparatus was driven with turning on electricity were performed for 5 days corresponding to 150,000 copies without passing paper to evaluate occurrence of cracks on the conductive member during the test. The test was performed at a temperature of 23° C. and a relative humidity (RH) of 50% and in a condition that a power voltage was applied to the charging roller at DC=−700V, AC Vpp=2.7 kV with a frequency of 3 kHz.

As a result, cracks on the electrical resistance adjusting layer of the conductive member in each of the Examples 1 to 5 were not observed. Accordingly, it was found that these conductive members in each of the Examples 1 to 5 have a excellent durability for a long time in use, which can prevent cracks from occurring.

On the other hand, cracks on the electrical resistance adjusting layer of the conductive member of the Comparative Examples 1 to 4 were observed. Accordingly, it was found that the durability was not sufficient under the condition of the above test.

(Test 2)

The image forming apparatus shown in FIG. 2 was used as an acceleration test device. The above-described conductive member was used as a charging member (charging roller) and images were evaluated at a low temperature and a low humidity (10° C., RH15%). A power voltage was applied to the charging roller at DC=−600V, AC Vpp=2.3 kV with a frequency of 2.2 kHz and an image unevenness due to variation of resistance values and forming of an abnormal image due to abnormal discharge (leak) was evaluated.

Figure 12:
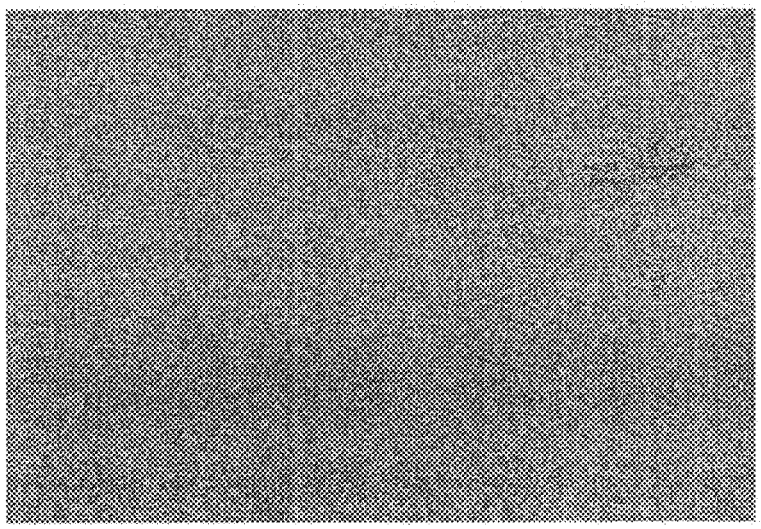
FIG. 12 is an example of an image obtained by an image forming apparatus using a conductive member according to an embodiment of the present invention as a charging member under a condition of a low temperature and a low humidity.
Figure 13:
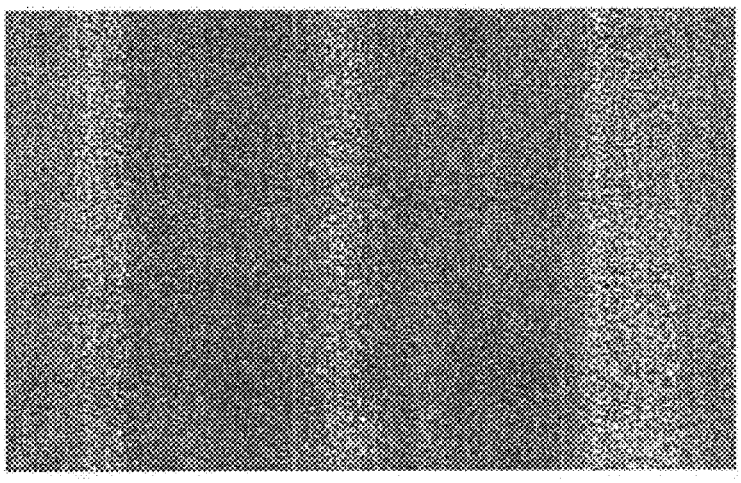
FIG. 13 is an example of an image obtained by an image forming apparatus using a conductive member according to a comparative example as a charging member under a condition of a low temperature and a low humidity.

In the case of the conductive member of each of the Examples 1 to 5, a good image uniformly formed without unevenness as shown in FIG. 12 was obtained even under low temperature and low humidity conditions. On the other hand, in the case of the conductive member of each of the Comparative Examples 1 to 4, an abnormal image with an elongate macular or in a white or black macular state near a center portion or at right and left end portions of the image as shown in FIG. 13 was obtained. The axial direction of the conductive member corresponds to a lateral direction of each of FIGS. 12 and 13.

Since the conductive member according to an embodiment of the present invention allows cracks to be prevented from occurring for a long time in use, it can be preferably used as a charging member in an image forming apparatus.

According to a conductive member of an embodiment of the present invention, cracks can be preliminarily prevented from occurring at weld portions formed in molding and long lasting and high durability of the conductive member can be achieved.

According to the conductive member of an embodiment of the present invention, a thermoplastic resin composition and a polymeric ion conductive material are optimized.

According to the conductive member of an embodiment of the present invention, the conductive member is formed in an elongate shape in an axial direction of the conductive member so that cracks can be effectively prevented from occurring.

According to the conductive member of an embodiment of the present invention, partial charging failure due to variation of resistance values of the electrical resistance adjusting layer can be effectively controlled.

According to the conductive member of an embodiment of the present invention, required strength and resistance value for the electrical resistance adjusting layer can be easily achieved.

According to the conductive member of an embodiment of the present invention, a required dispersion particle size, that is to say, a desired size of each of the island portions in the sea-island structure can be easily obtained.

According to the conductive member of an embodiment of the present invention, since the graft copolymer having the polycarbonate as the main chain and the acrylonitrile-styrene-glycidyl methacrylate copolymer as the sub chain is used, the graft copolymer can function as a compatibilizer for the polymeric ion conductive material and the thermoplastic resin. Consequently, occurrence of cracks on the weld portion due to electrical or mechanical stress when used or volume fluctuation with time or an environmental change can be effectively prevented.

According to the conductive member of an embodiment of the present invention, since a non-adhesive property of the surface layer can be easily ensured, in a case where the conductive member is used as a charging member in an image forming apparatus, adhering of dust can be effectively prevented so that forming good images can be achieved for a long time in use.

According to the conductive member of an embodiment of the present invention, required resistance value of the surface layer can be easily obtained.

According to the conductive member of an embodiment of the present invention, since the conductive member is in a cylindrical shape, partial degradation of a surface of the conductive member due to continuous application of current from a specific part of the conductive member can be prevented. Consequently, long lasting of the conductive member can be achieved.

According to the conductive member of an embodiment of the present invention, the conductive member can be preferably used in an image forming apparatus.

According to a process cartridge of an embodiment of the present invention, since the process cartridge has the conductive member and is detachably used, maintenance work can be easily performed.

According to an image forming apparatus of an embodiment of the present invention, occurrence of cracks on a weld portion formed in molding can be preliminarily prevented. Since the image forming apparatus has charging member having high durability for a long time in use, maintenance work is not frequently required and image blur at a weld portion of the charging member can be prevented to form good images.

Although the preferred embodiments of the present invention have been described, it should be noted that the present invention is not limited to these embodiments, and various changes and modifications can be made to the embodiments.

What is claimed is:

1. A conductive member, comprising:

a conductive support; and an electrical resistance adjusting layer formed on the conductive support, wherein the electrical resistance adjusting layer includes a thermoplastic resin, a polymeric ion conductive material, and a graft copolymer which is compatible with both of the thermoplastic resin and the polymeric ion conductive material;

the electrical resistance adjusting layer is formed in a sea-island structure formed from a sea portion made of the polymeric ion conductive material and island portions made of the thermoplastic resin, the island portions being dispersed in the sea portion;

each of the island portions is formed in an elongate shape to be elongated in an axial direction of the conductive member; and a layer made of the graft copolymer is formed at boundaries between the thermoplastic resin and the polymeric ion conductive material, wherein the conductive member has a cylindrical shape.

2. The conductive member according to claim 1, further comprising a surface layer formed on a surface of the electrical resistance adjusting layer.

3. The conductive member according to claim 1, wherein the thermoplastic resin is a polycarbonate and the polymeric ion conductive material is a polyether-ester-amide.

4. The conductive member according to claim 1, wherein a diameter of each of the island portions in a short axial direction of each of the island portions is 10 μm or less.

5. The conductive member according to claim 3, wherein when a sum of a ratio of the polycarbonate and a ratio of the polyether-ester-amide is 100 parts by weight, the ratio of the polyether-ester-amide is 50 to 90 parts by weight, the ratio of the polycarbonate is 10 to 50 parts by weight, and a ratio of the graft copolymer is 1 to 15 parts by weight.

6. The conductive member according to claim 1, wherein the graft copolymer include polycarbonate as a main chain and acrylonitrile-butadiene-styrene copolymer as a side chain.

7. The conductive member according to claim 3, wherein the electrical resistance adjusting layer is prepared by melting and kneading the polycarbonate and the polyether-ester-amide, and the graft copolymer.

8. The conductive member according to claim 2, wherein the surface layer is formed from one or more of acrylic resin, acrylic silicon resin, polyurethane resin, fluorine resin, polyester resin, polyamide resin, and poly(vinyl butyral).

9. The conductive member according to claim 2, wherein the surface layer is formed from a resin in which a conductive agent is dispersed.

10. The conductive member according to claim 1, wherein the conductive member is cylindrical.

11. A process cartridge, having the conductive member according to claim 10.

12. An image forming apparatus, having at least one process cartridge according to claim 11.

* * * * *